US005862443A

United States Patent [19]

Ikegawa et al.

[11] Patent Number: 5,862,443

[45] Date of Patent: Jan. 19, 1999

[54] ELECTROSTATIC RECORDING APPARATUS HAVING A FLOATING ELECTRODE ON A PHOTOELECTRIC TRANSFER MEMBER

[75] Inventors: Akihito Ikegawa, Sakai; Isao Doi, Toyonaka; Keiko Momotani, Suita, all of Japan

[73] Assignee: Minolta Co., Ltd., Osaka, Japan

[21] Appl. No.: 856,604

[22] Filed: May 15, 1997

[30] Foreign Application Priority Data

May 15, 1996 [JP] Japan ..... 8-120103
May 15, 1996 [JP] Japan ..... 8-120107
May 15, 1996 [JP] Japan ..... 8-120168

[51] Int. Cl.[6] ..... G03G 15/18

[52] U.S. Cl. ..... 399/136; 347/112

[58] Field of Search ..... 399/136; 430/48; 347/120, 112, 141, 129, 147; 365/112

[56] References Cited

U.S. PATENT DOCUMENTS 5,128,893 7/1992 Takanashi et al. ..... 365/112

FOREIGN PATENT DOCUMENTS 1-293358 11/1989 Japan .

*Primary Examiner*—Joan Pendegrass
*Attorney, Agent, or Firm*—McDermott, Will & Emery

[57] ABSTRACT

An electrostatic recording apparatus 1 for forming an electrostatic image on an electric charge carrying member 2 comprises a photoelectric transfer member 14 spaced from the electric charge carrying member 2, a floating electrode 16 provided on a first surface of the photoelectric transfer member 14, an electric power supply 27 for applying a voltage between the second surface of the photoelectric transfer member 14 and the second surface of the electric charge carrying member 2, and an exposure device 8 for exposing a second surface of the photoelectric transfer member 14. The floating electrode 16 having an electric discharge terminal 18*a* close to the electric charge carrying member 2. When the exposure device 8 exposes a second surface of the photoelectric transfer member 14, the carriers generated in the photoelectric transfer member 14 move toward the floating electrode 16 to cause an electric discharge between the electric discharge terminal 18*a* of the floating electrode 16 and the electric charge carrying member 2, which allows an electrostatic image to be formed on the electric charge carrying member 2.

25 Claims, 9 Drawing Sheets

ELECTROSTATIC RECORDING APPARATUS HAVING A FLOATING ELECTRODE ON A PHOTOELECTRIC TRANSFER MEMBER

BACKGROUND OF THE INVENTION

The present invention relates to an electrostatic recording apparatus used for an image forming apparatus, a printer and so on.

Conventionally, as an electric recording apparatus for forming an electrostatic image on an electric charge carrying member, a photosensitive member as shown in FIG. 14 is proposed in, for example, Japanese Patent Laid-Open Publication No. HEI 1-293358. The photosensitive member 101 is constructed by laminating a photoconductive layer support member 103, a photosensitive member electrode 104 and a photoconductive layer 105 in this order. On the other hand, the electric charge carrying member 102 has a rotatable cylindrical configuration and is constructed by laminating an insulating layer support member 106, an electric charge carrying member electrode 107 and an insulating layer 108 in this order. The photosensitive member 101 and the electric charge carrying member 102 are arranged so that the photoconductive layer 105 and the insulating layer 108 face each other via an air gap.

By applying a voltage between the photosensitive member electrode 104 and the electric charge carrying member electrode 107 and performing scanning in the axial direction (main scanning direction) of the electric charge carrying member 102 with light incident on the photosensitive member 101 in a dark place, a portion of the photoconductive layer 105 exposed to the light becomes conductive. Thus, an electric discharge is generated between the exposed portion and the insulating layer 108 of the electric charge carrying member 102, so that electric charges are accumulated in the insulating layer 108 of the electric charge carrying member 102 to form an electrostatic latent image. The formed electrostatic latent image is moved in a direction indicated by an arrow "b" in FIG. 14 to be developed into a toner image by a developing unit 109. The toner image is transferred onto a paper or a film by a transfer charger 110.

However, when forming an image with the aforementioned apparatus as shown in FIG. 14, there is a possibility that a dot-like image is formed, or that a rear end portion of the image is elongated, which makes it difficult to obtain a stable image. This is considered to be caused by the reason that a fast and stable electric discharge does not occur, or that an electric discharge is intermittently carried out or continuously carried out after completion of exposure.

SUMMARY OF THE INVENTION

An object of the present invention is to eliminate the intermittent electric discharge or the continuous electric discharge after completion of exposure and to provide an electrostatic recording apparatus in which a fast and stable electric discharge is carried out.

The present inventors investigated the cause of the intermittent of the image and the elongation of the image rear end portion. As a result, it was found out that since electric-discharge points on the photosensitive member are not stable, the electric discharge is caused at different positions from the desired positions on the electric charge carrying member, thereby an electrostatic latent image is not formed in the regular position; since an electrostatic latent image has been already formed, the electric discharge is not caused; and these result in the intermittence of the image and the elongation of the image rear end portion.

The present invention is made on the basis of the aforementioned findings. The present invention aims to provide a stable electric discharge repeatedly at a desired position on the image carrying member.

(1) According to the first aspect of the present invention, there is provided an electrostatic recording apparatus for forming an electrostatic image on an electric charge carrying member, comprising:

a photoelectric transfer member which is spaced from the electric charge carrying member with a predetermined distance and generates carriers when being exposed to light;

a floating electrode provided on a first surface of the photoelectric transfer member, the floating electrode being opposed to a first surface of the electric charge carrying member, the floating electrode having an electric discharge terminal close to the electric charge carrying member;

an electric power supply for applying a voltage between the second surface of the photoelectric transfer member and the second surface of the electric charge carrying member so that the electric potential of the photoelectric transfer member is higher than that of the electric charge carrying member; and an exposure device for exposing a second surface of the photoelectric transfer member, whereby the carriers generated in the photoelectric transfer member move toward the floating electrode to cause an electric discharge between the electric discharge terminal of the floating electrode and the electric charge carrying member, which allows an electrostatic image to be formed on the electric charge carrying member.

In the electrostatic recording apparatus so constructed above, since the floating electrode is provided on the photoelectric transfer member, an electric field in the photoelectric transfer member is formed not in a straight line toward the electric charge carrying member but in a concentrated state on the floating electrode. Moreover, the floating electrode has the electric discharge terminal close to the electric charge carrying member, the carriers which move toward the floating electrode concentrate on the electric discharge terminal, thereby the electric discharge is caused from the electric discharge terminal to the electric charge carrying member.

Thus, in spite of the exposure position of the photoelectric transfer member, the electric discharge is caused from the electric discharge terminal, which allows the position of the electric discharge to be specified. Consequently, it is eliminated that the electrostatic latent image is intermittently formed on the electric charge carrying member or formed on an undesired position where the light is not irradiated. Therefore, the carriers generated in the photoelectric transfer member are discharged from the specified position, thereby an electrostatic latent image reliably corresponding to the exposure to the light signal is recorded on the electric charge carrying member.

(2) According to a second aspect of the present invention, there is provided an electrostatic recording apparatus for forming an electrostatic image on an electric charge carrying member, comprising:

a photoelectric transfer member which is spaced from the electric charge carrying member with a predetermined distance and generates carriers when being exposed to light;

a floating electrode provided on a first surface of the photoelectric transfer member, the floating electrode being opposed to a first surface of the electric charge carrying member;

an acceleration electrode positioned apart from the floating electrode with a predetermined distance toward the electric charge carrying member; and a first electric power supply for applying a voltage between the second surface of the photoelectric transfer member and the acceleration electrode so that the electric potential of the photoelectric transfer member is higher than that of the acceleration electrode;

a second electric power supply for applying a voltage between the acceleration electrode and the second surface of the electric charge carrying member so that the electric potential of the acceleration electrode is higher than that of the electric charge carrying member; and an exposure device for exposing a second surface of the photoelectric transfer member, whereby the carriers generated in the photoelectric transfer member move toward the floating electrode to cause an electric discharge between the floating electrode and the acceleration electrode, which allows an electric charge generated by the electric discharge to be held on the electric charge carrying member to form an electrostatic image.

In the electrostatic recording apparatus so constructed above, the electric discharge is caused between the floating electrode and the acceleration electrode which is positioned apart from the floating electrode with a predetermined distance toward the electric charge carrying member. The presence of the acceleration electrode promotes the concentration of the carriers on the floating electrode and makes the electric discharge stable.

Moreover, the distance between the electric discharge terminal and the acceleration electrode is constant, which enables more stable electric discharge to be repeatedly caused. By providing the acceleration electrode, a long distance between the electric discharge terminal of the floating electrode and the electric charge carrying member is ensured and a permissible range of the distance (air gap) is widened. Therefore, the adjustment of the gap as well as the work in both design and manufacturing stages become easier, which enables the cost reduction.

(3) According to a third aspect of the present invention, there is provided an electrostatic recording apparatus for forming an electrostatic image on an electric charge carrying member, comprising:

a photoelectric transfer member which is spaced from the electric charge carrying member with a predetermined distance and generates carriers when being exposed to light;

a floating electrode provided on a first surface of the photoelectric transfer member, the floating electrode being opposed to a first surface of the electric charge carrying member;

a supplementary electrode provided on the first surface of the photoelectric transfer member, the supplementary electrode being spaced from the floating electrode with a predetermined distance;

a first electric power supply for applying a voltage between the second surface of the photoelectric transfer member and the supplementary electrode so that the electric potential of the photoelectric transfer member is higher than that of the supplementary electrode;

a second electric power supply for applying a voltage between the supplementary electrode and the second surface of the electric charge carrying member so that the electric potential of the supplementary electrode is higher than that of the electric charge carrying member; and an exposure device for exposing a second surface of the photoelectric transfer member, whereby the carriers generated in the photoelectric transfer member move toward the floating electrode to cause an electric discharge between the floating electrode and the supplementary electrode, which allows an electric charge generated by the electric discharge to be held on the electric charge carrying member to form an electrostatic image.

In the electrostatic recording apparatus so constructed above, since the electric discharge is caused between the floating electrode and the supplementary electrode which is provided on the photoelectric transfer member, it has substantially same advantages as that of aforementioned electrostatic recording apparatus according to the second aspect of the present invention.

In addition, since the floating electrode and the supplementary electrode are possible to form on the same surface of the photoelectric transfer member, the manufacturing of the photoelectric transfer device becomes easier, which enables the cost reduction.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS FIRST EMBODIMENT

Figure 1:
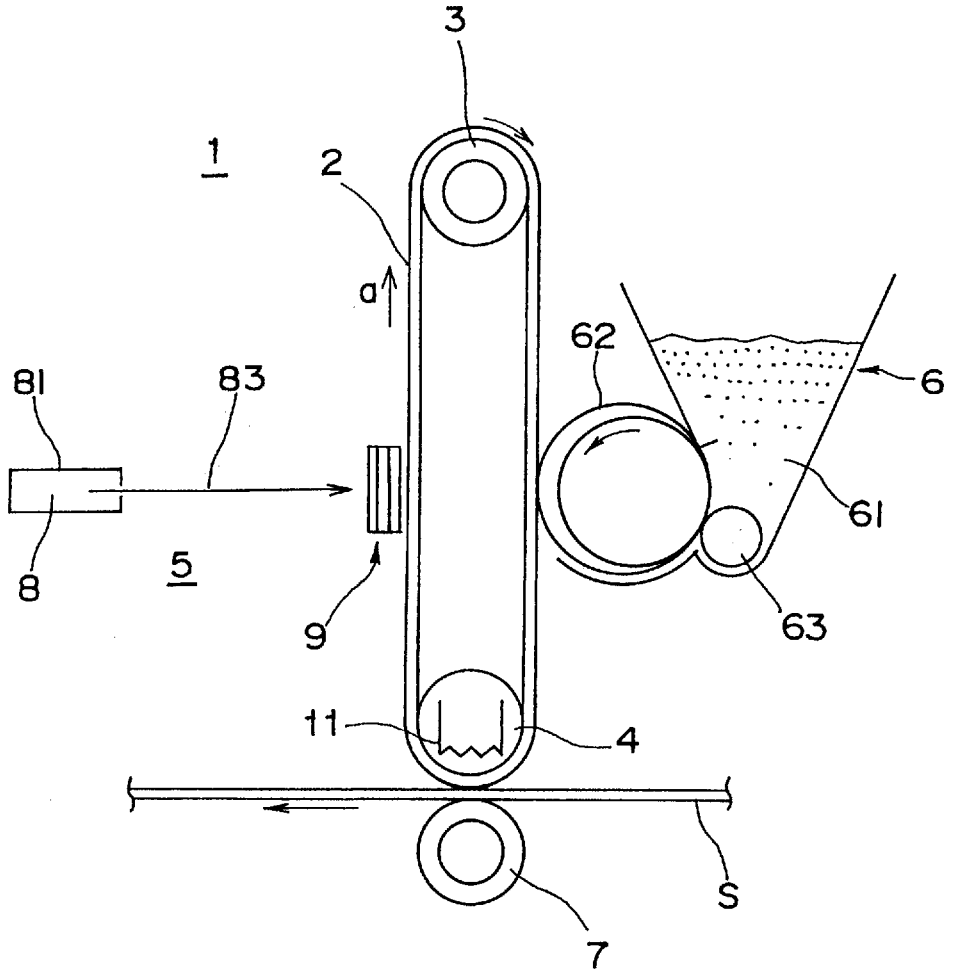
FIG. 1 is a sectional view of an image forming apparatus according to a first embodiment of the present invention.
Figure 2:
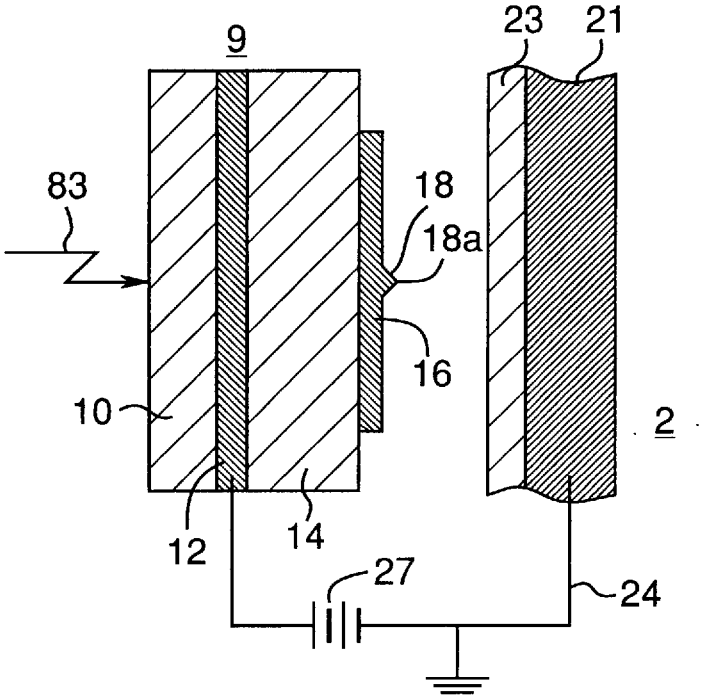
FIG. 2 is an enlarged sectional view of a photoelectric transfer device and an image carrying belt of the image forming apparatus in FIG. 1.

FIG. 1 shows a schematic view of an image forming apparatus 1 according to a first embodiment of the present invention, while FIG. 2 shows a partially enlarged sectional view of an essential part of the photoelectric transfer device 9 and an image carrying belt 2.

In a center portion of the image forming apparatus 1 is arranged the image carrying belt 2 which serves as an electric charge carrying member. This image carrying belt 2 is made to run in a direction indicated by an arrow "a" by a driving roller 3 which is rotated by a drive unit (not shown) and a heating roller 4 provided in parallel with the driving roller 3.

As shown in FIG. 2, the image carrying belt 2 is provided by forming a dielectric layer 23 on a base 21 which serves as an conductive layer. In particular, the dielectric layer 23 comprises a polyethylene terephthalate having a thickness of about 10 $\mu$m provided on the base 21, which is formed as of a conductive film having a width of 25 cm and a perimeter of 30 cm. The base 21 is grounded by a conductive wire 24.

Around the image carrying belt 2 as mentioned above are provided an latent image forming unit 5, a developing unit 6 and a transfer roller 7 in this order in the direction indicated by the arrow "a" in FIG. 1.

The latent image forming unit 5 comprises an optical system 8 and a photoelectric transfer device 9 disposed between the optical system 8 and the image carrying belt 2. The optical system 8 is constructed by arranging a semiconductor laser generator as a light source, a collimator lens, a polygon mirror, an F θ-lens, a reflecting mirror and so forth in a housing 81. This optical system 8 is constructed so that a laser light beam 83 generated by the semiconductor laser generator is applied through the exposure slit formed in the housing 81 to the photoelectric transfer device 9, thereby allowing image exposure to be achieved.

In this case, the direction in which the laser light beam 83 performs the scanning exposure is the widthwise direction of the image carrying belt 2 (in the front-back direction in FIG. 1), and this direction will be referred to as a main scanning direction hereinafter. Further, the direction in which the image carrying belt 2 runs (the vertical direction in FIG. 1) perpendicularly to the main scanning direction will be referred to as a sub-scanning direction.

The photoelectric transfer device 9, as shown in FIG. 2, is constructed so that a transparent conductive layer 12, a photoelectric transfer layer 14 and a floating electrode 16 are laminated in this order on a transparent substrate 10. The photoelectric transfer device 9 is disposed so that the floating electrode 16 is opposite to the image carrying belt 2 via an air gap.

The transparent substrate 10 is made of transparent glass plate. The transparent conductive layer 12 comprises an ITO film of conductive material and a polyamide resin film as an injection preventing layer. Further, to the ITO film of the transparent conductive layer 12 is connected a first power source 27.

The photoelectric transfer layer 14 is for negative charges and has a good sensitivity to light of a long wavelength such as a semiconductor laser light (having a wavelength of 780 nm) or an LED light (having a wavelength of 680 nm). The photoelectric transfer layer 14 is a function separating type and comprises a charge generating layer (CGL) having a carrier pairs generating function and a charge transporting layer (CTL) having a free carriers transferring function. The photoelectric transfer layer 14 is disposed so that the charge generating layer comes into contact with the injection preventing layer of the transparent conductive layer 12.

Figure 3:
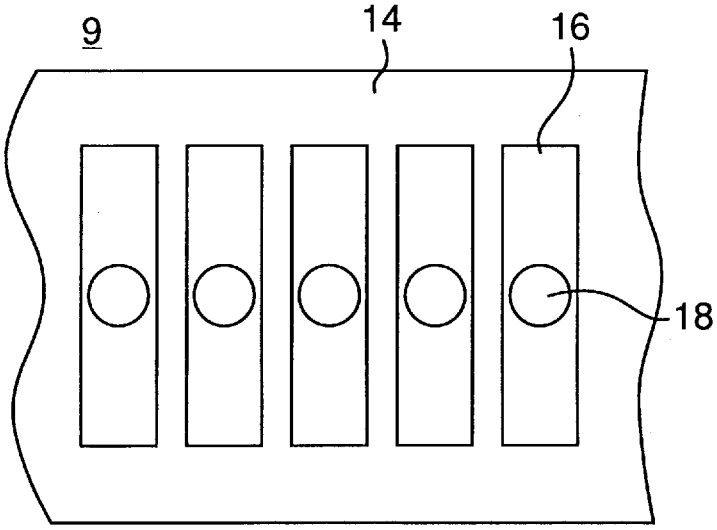
FIG. 3 is a view of a face of the photoelectric transfer device in FIG. 2 opposite to the image carrying member.

The floating electrode 16, as clearly shown in FIG. 3, comprises a plurality of electrodes which are provided so as to come into contact with the charge transporting layer of the photoelectric transfer layer 14 and disposed in parallel to each other at regular intervals in the main scanning direction. Each electrode of the floating electrode 16 corresponds to the picture element of print. Moreover, on an opposite surface of the floating electrode to the contact surface with the photoelectric transfer layer 14, each electrode of the floating electrode 16 is formed with a projection 18 having a needle-like tip end 18*a* which serves as an electric discharge terminal portion. The projection 18 protrudes toward the image carrying belt 2 from the photoelectric transfer device 9 so that the needle-like tip end 18*a* of the projection 18 is positioned at the closest position to the image carrying belt 2 among the floating electrode 16.

In order to keep the air gap constant between the photoelectric transfer device 9 and the image carrying belt 2, a spacer may be provided between them. The spacer is preferably comprised of a material, which has a small coefficient of friction with respect to the image carrying belt 2 and hardly impairs it, such as fluororesin.

The aforementioned developing unit 6 comprises a toner storage section 61 for storing therein a single-component developer (referred to as a toner hereinafter), a developing sleeve 62 arranged in close vicinity to the image carrying belt 2 and a supply roller 63 for supplying the toner stored in the toner storage section 61 to the developing sleeve 62 while agitating the toner. The toner to be used in this developing unit 6 is a negative charge type and has a mean particle diameter of 10 $\mu$m obtained by kneading, pulverizing and classifying by a known method a mixture having bisphenol A polyester resin and carbon black as main ingredients.

To the developing sleeve 62 is applied an appropriate developing bias voltage for the purpose of preventing a background fogging and the like.

The transfer roller 7 faces the heating roller 4 via the image carrying belt 2 and is arranged in pressure contact with the image carrying belt 2. A recording paper S is made to pass between this transfer roller 7 and the image carrying belt 2.

In regard to the image forming apparatus 1 constructed as above, a latent image forming process will be described first.

A voltage (Vc) of 1.2 kV is applied to the transparent conductive layer 12 of the photoelectric transfer device 9 by the first power source 27. Therefore, an electric field due to a voltage difference of 1.2 kV is formed between the transparent conductive layer 12 and the grounded base 21 of the image carrying belt 2.

When the laser light beam 83 generated by the optical system 8 is applied for exposure to the photoelectric transfer device 9 in the state in which the electric field is formed as described above, the laser light beam 83 transmits itself through the transparent substrate 10 and the transparent conductive layer 12 to reach the photoelectric transfer layer 14. The charge generating layer of the photoelectric transfer layer 14 generates carrier pairs upon absorbing light under the existence of an electric field. Among the generated carrier pairs, each freed carrier moves toward the opposite electrode having the inverse polarity. In this stage, each freed positive carrier moves through the inside of the charge transporting layer to the floating electrode 16. By this operation, the electric field in the air gap between the floating electrode 16 and the surface of the image carrying belt 2 increases. When this electric field exceeds a threshold value determined upon a Paschen's law, an electric discharge is generated. At this time, since the tip end 18*a* of the projection 18 of the floating electrode 16 is closest to the image carrying belt 2, the electric discharge is caused between the tip end 18*a* and the image carrying belt 2. Thus, the surface of the dielectric layer 23 of the image carrying belt 2 corresponding to the position of exposure of the photoelectric transfer device 9 is electrically charged, so that an electrostatic latent image is formed.

The floating electrode 16 is formed in a belt-like configuration extending in the sub-scanning direction as shown in FIGS. 2 and 3. Even though the irradiation light is shifted in the sub-scanning direction due to an inclination error of the polygon mirror and so on when irradiating the laser beam 83 for exposure, the carrier transferred to the floating electrode 16 freely moves within the floating electrode 16 to be concentrated on the tip end 18*a* of the projection 18 which is closest to the image carrying belt 2, causing an electric discharge. Therefore, an electrostatic latent image is formed in a specific position on the image carrying belt 2 in spite of the shift of the exposure position. In addition, a frequency of using a specified area of the photoelectric transfer layer 14 is reduced by consciously fluctuating the irradiation light in the sub-scanning direction, resulting in long span of product life of the photoelectric transfer device.

A process after the formation of the latent image will be described as follows.

The electrostatic latent image formed on the image carrying belt 2 is conveyed to the developing section by the rotation of the driving roller 3 and the heating roller 4 and then developed with toner by the developing unit 6. Subsequently, a toner image formed on the image carrying belt 2 is further conveyed by the rotation of the driving roller 3 and the heating roller 4 and heated by a heating member 11 provided inside the heating roller 4 while being concurrently transferred onto a recording paper S by the transfer roller 7. In this stage, the toner image is fused and transferred, and therefore, no toner is left on the image carrying belt 2, meaning that almost the whole the toner is transferred onto the recording paper S and concurrently fixed.

As the photoelectric transfer device 9 of the aforementioned embodiment, one manufactured by the following method is used.

First, a transparent conductive layer 12 was formed on the surface of an approximately plate-shaped transparent substrate 10 elongated in the main scanning direction, or in detail, a transparent glass plate having a width of 250 mm in the main scanning direction, a width of 30 mm in the sub-scanning direction and a thickness of 3 mm. For the transparent conductive layer 12, an ITO film was formed by a thickness of about 0.2 $\mu$m by the known ion plating method (it is assumed that the ITO film has a sheet resistivity of about 100 Ω/□), and an about 0.5 $\mu$m thick of polyamide resin layer was further coated as an injection preventing layer on it by the dipping method.

Subsequently, one part by weight of τ (tau) type metal-free phthalocyanine, two parts by weight of polyvinyl butyral resin and 100 parts by weight of tetrahydrofuran were put in a ball mill pot and dispersed for 24 hours, so that a photosensitive paint was obtained. The photosensitive paint has a viscosity of 15 cp at a temperature of 20° C. in this stage. As the polyvinyl butyral resin, one which has a degree of is acetylation of not greater than three molar percent, a degree of butylation of 70 molar percent and a degree of polymerization of 1000 was used.

Then, this photosensitive paint was coated on the surface of the transparent conductive layer 12 by the dipping method, so that a charge generating layer having a film thickness of 0.4 $\mu$m was formed after drying.

Then, a coating liquid in which eight parts by weight of a hydrazone compound expressed by the following structural formula (Formula 1), 0.1 part by weight of an orange pigment and 10 parts by weight of polycarbonate resin are dissolved in a solvent comprised of 180 parts by weight of tetrahydrofuran was coated on the charge generating layer by the dipping method and dried, so that the charge transporting layer having a film thickness of 21 $\mu$m was formed.

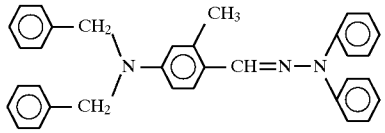

(Formula I)

Then, a plurality of floating electrodes 16 parallel in the sub-scanning direction as shown in FIG. 3 were provided on the surface of the photoelectric transfer layer 14, or in detail, on the surface of the charge transporting layer. The plurality of floating electrodes 16 were formed in a rectangular shape respectively by applying conductive paste by the screen printing. The floating electrodes 16 were formed so as to have a pitch of 80 $\mu$m in the main-scanning direction, a width of 50 $\mu$m in the main-scanning direction, a length of 20 $\mu$m in the sub-scanning direction, and a thickness of 5 $\mu$m. On a substantially center of each floating electrode 16 was formed a cone-like projection 18 having a height of 10 $\mu$m from the surface of the floating electrode 16 and a base diameter of 50 $\mu$m.

In regard to the construction of the photoelectric transfer layer 14, it may be an inverted laminate type or so-called the single layer type instead of the aforementioned function separating type. Furthermore, it is proper to appropriately select a known material for the charge generating material, charge transfer material, binding resin and additives according to purposes. In addition, the photosensitive material is not limited to the organic material, and it is acceptable to use an inorganic material such as zinc oxide, cadmium sulfide, selenium based alloy, amorphous silicon based alloy or amorphous germanium alloy. Furthermore, it is acceptable to provide a known undercoating layer for the purpose of improving the charge characteristic, image quality and adhesion to the base. The transparent substrate 10 is not limited to the glass plate, and it is acceptable to use any kind of substrate or support which is transparent to the exposure light.

For the floating electrode 16, a metal material such as such as chromium, titanium, magnesium, gold or platinum, or a conductive oxide film such as tin oxide, indium oxide or ITO, or a material such as a conductive paste or a conductive ink can be used instead of aluminum. There is no specific limitation on the floating electrode 16 so long as it is conductive. However, particularly in a construction in which no surface protection layer 99 is provided, the surface electrode layer 98 is directly exposed to electric discharge, and therefore, it is preferable to use a material of which oxidation hardly progresses.

The method of forming the floating electrode 16 is not limited to this, and it is acceptable to form an electrode by the ion plating method or the sputtering method instead of vapor deposition. Furthermore, it is acceptable to form a pattern by a photolithographic method after forming the electrode by the aforementioned method without using any mask sheet. Furthermore, it is acceptable to perform printing by using a conductive paste or a conductive ink.

Instead of ITO film used for the transparent conductive layer 12, a transparent conductive material may be used. In this case, as the transparent conductive material is preferably adopted such a material that a sheet resistivity is less than about 1000 Ω/□ in order to avoid a voltage drop. The method of forming the conductive layer is not limited to the aforementioned method, and it is acceptable to form a conductive layer by a printing method or a sputtering method instead of the ion plating method and the vapor deposition.

As to the injection preventing layer, its material is not limited to the polyamide resin, and it is acceptable to use a known transparent material.

As to the dielectric layer 23, its material is not limited to the polycarbonate or the polyethylene terephthalate, and it is acceptable to use a known dielectric material such as acrylic or polypropylene. It is to be noted that the electric resistivity of the material of the aforementioned dielectric layer 23 is preferably set to $10^{11}$ Ωcm or higher in order to prevent the reduction of the charge potential with the elapse of time. There is no limitation on the thickness of the dielectric layer 25 if it is within the range in which there is no problem of strength in terms of practical handling and durability, and it is generally considered appropriate that the thickness is 2 to 100 μm.

Figure 4:
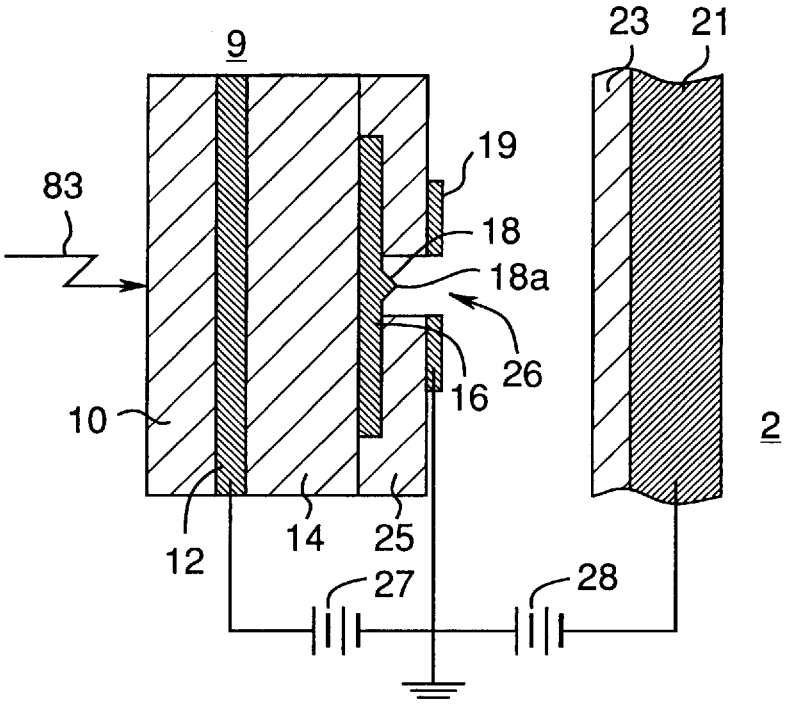
FIG. 4 is an enlarged sectional view of a first variation of the photoelectric transfer device and the image carrying belt in FIG. 1.

FIG. 4 shows a first variation of the photoelectric transfer device and the image carrying belt of the image forming apparatus in FIG. 1 and is a view corresponding to that of FIG. 2.

The photoelectric transfer device 9 as shown in FIG. 4 is identical with that of the first embodiment as shown in FIG. 2 except a construction having an acceleration electrode 19. A same numeral is affixed to the similar portion so as to omit the explanation thereof.

The photoelectric transfer device 9 is comprised of the transparent substrate 10 (support member), the transparent conductive layer 12, the photoelectric transfer layer 14, and the floating electrode 16 having the projection 18 in the same manner as that of the first embodiment in FIG. 2. The photoelectric transfer device 9 is further comprised of a dielectric layer 25 laminated on the floating electrode 16 other than the projection 18 and a conductive layer for the acceleration electrode 19 laminated on the dielectric layer 25.

Although the image carrying belt 2 has the same construction as that of the first embodiment in FIG. 2, a minus voltage is applied to the base 21 thereof by a second electric supply 28 in order to ensure the capturing of electric charge during the electric discharge.

Figure 5:
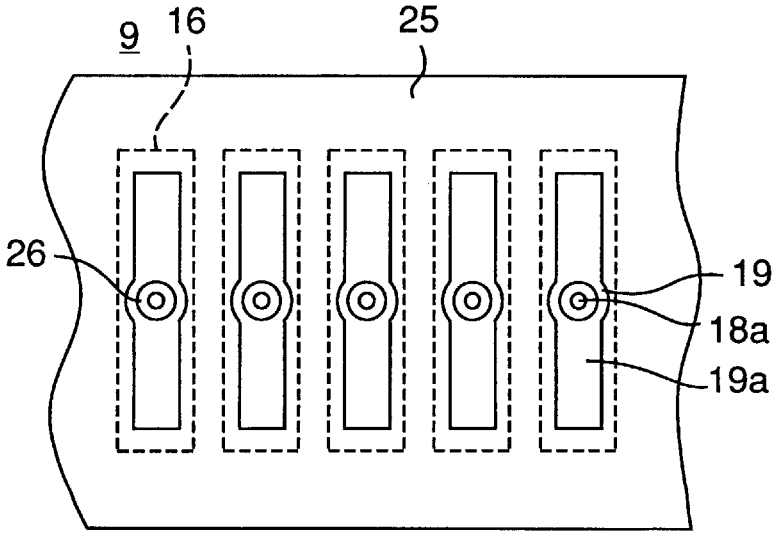
FIG. 5 is a view of a face of the photoelectric transfer device in FIG. 4 opposite to the image carrying member.

As clearly shown in FIG. 5, at the positions where the projections 16 are formed, the dielectric layer 25 is provided with recesses 26 in a line the number of which is corresponding to that of the floating electrodes 16. On an open edge portion of each recess 26, the acceleration electrode 19 is formed in a ring-like configuration for accelerating the electric discharge from the tip end 18*a* of the projection 18. Each acceleration electrode 19 is grounded through its terminal portion 19*a* so that a voltage difference is caused between the acceleration electrode 19 and the tip end 18*a* of the projection 18 of the floating electrode 16 when the electric potential of the floating electrode 16 is increased.

The configuration of the acceleration electrode is not limited to the ring-like configuration, it is acceptable such a configuration that makes the electric discharge between the acceleration electrode 16 and the tip end 18*a* of the projection 18 caused and makes a part of electric charge moved to the image carrying belt 2, for example, a parallel line configuration is also acceptable.

In the image forming apparatus constructed as above, a voltage (Vc) of 1.2 kV is applied to the transparent conductive layer 12, the acceleration electrodes 19 are grounded (0 V), and a voltage of −(minus) 1 kV is applied to the base 21 of the image carrying belt 2 from the second electric supply 28.

In this condition, when a laser light 83 is irradiated to the photoelectric transfer layer 14, the floating electrode 16 including the projection 18*a* increases in electric potential so that an electric discharge occurs between the tip end 18*a* of the projection 18 and the acceleration electrode 19, whereby a part of charge is drawn to the image carrying belt 2 to form an electrostatic latent image on the dielectric layer 23.

By providing the acceleration electrode 19, a long distance between the electric discharge terminal 18 of the floating electrode 16 and the image carrying belt 2 is ensured and a permissible range of the distance is widened. Thus, even if the distance between the electric discharge terminal 18 and the image carrying belt 2 varies a little due to an irregular or a deformation of the image carrying belt 2, it is acceptable. Therefore, the work in both design and manufacturing stages become easier, which enables the cost reduction. Moreover, the electric discharge terminal 18 of the floating electrode 16 and the other electric discharge terminal 18, i.e., the acceleration electrode 19 keep a constant distance, the electric discharge between them is carried out in more stable condition.

Although, in above mentioned embodiment and its variation, the floating electrode 16 is provided with the projection 18 the tip end of which in turn is brought closest to the image carrying belt 2, a positional relation between the photoelectric transfer device 9 and the image carrying belt 2 may be established so that an end portion 16*a* of the floating electrode 16 becomes an electric discharge terminal portion closest to the image carrying belt 2.

Figure 6:
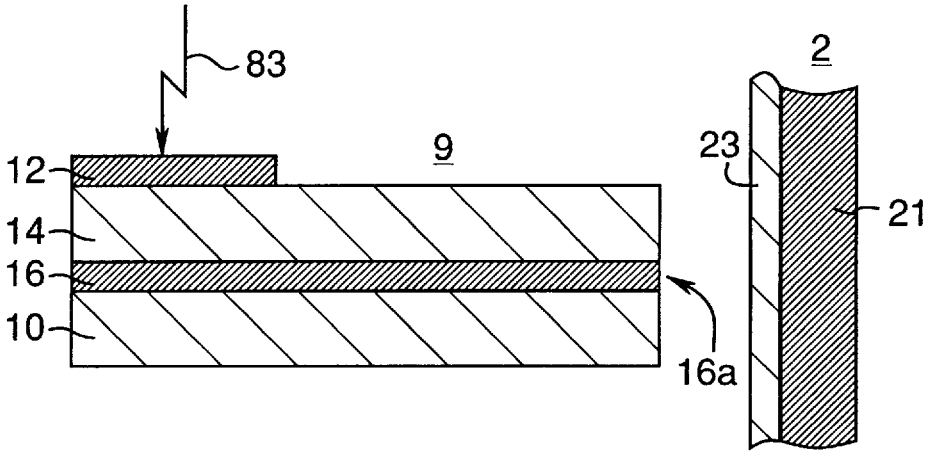
FIG. 6 is an enlarged sectional view of a second variation of the photoelectric transfer device and the image carrying belt in FIG. 1.

In the image forming apparatus as shown in FIG. 6, the photoelectric transfer device 9 was constructed by forming a plurality of elongated floating electrodes 16 parallel to each other on a grass plate 10, laminating a photoelectric transfer layer 14 thereon, and forming a transparent conductive layer 12 on the one third of the surface of the photoelectric transfer layer 14. The photoelectric transfer device 9 is so positioned that: the floating electrodes 16 is at an angle of 90 degrees relative to the surface of the image carrying belt 2; one end portion 16*a* of the floating electrode 16 is closest to the image carrying belt 2 to serve as an electric discharge terminal portion; and at the side of another end portion of the floating electrode 16 is present the transparent conductive layer 12.

Alternatively, the floating electrodes 16 may be at an angle of 60 degrees relative to the surface of the image carrying belt 2.

Figure 7:
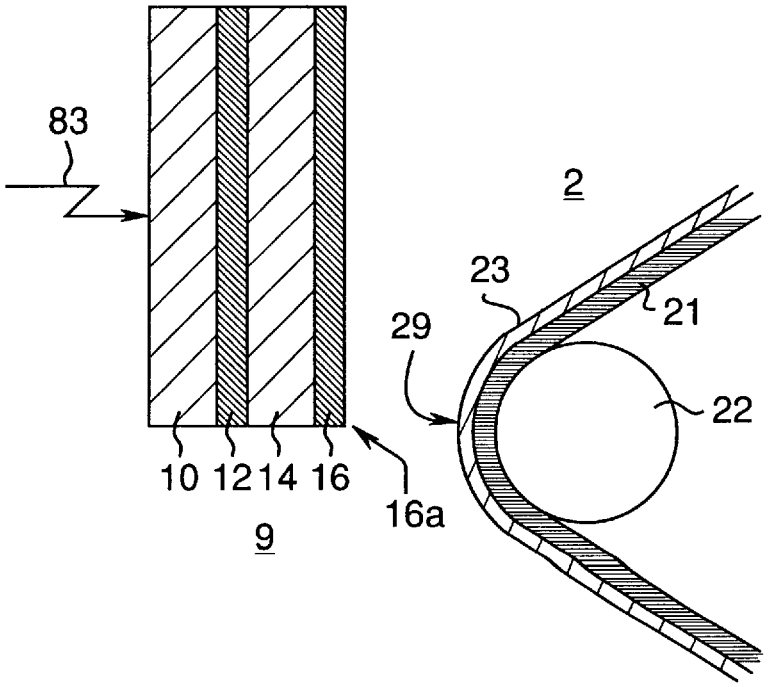
FIG. 7 is an enlarged sectional view of a third variation of the photoelectric transfer device and the image carrying belt in FIG. 1.

In the image forming apparatus as shown in FIG. 7, the photoelectric transfer device 9 was constructed in the similar manner as in FIG. 2 except that the surface of each floating electrode 16 was flat without projection. The image carrying belt 2 was bent by a roller 22 to form a peak portion 29 which is closest to an end portion 16*a* of each floating electrode 16, thereby the end portion 16*a* serves as an electric discharge terminal portion.

Alternatively, the image carrying belt 2 may be replaced by a small diameter of drum.

SECOND EMBODIMENT

Figure 8:
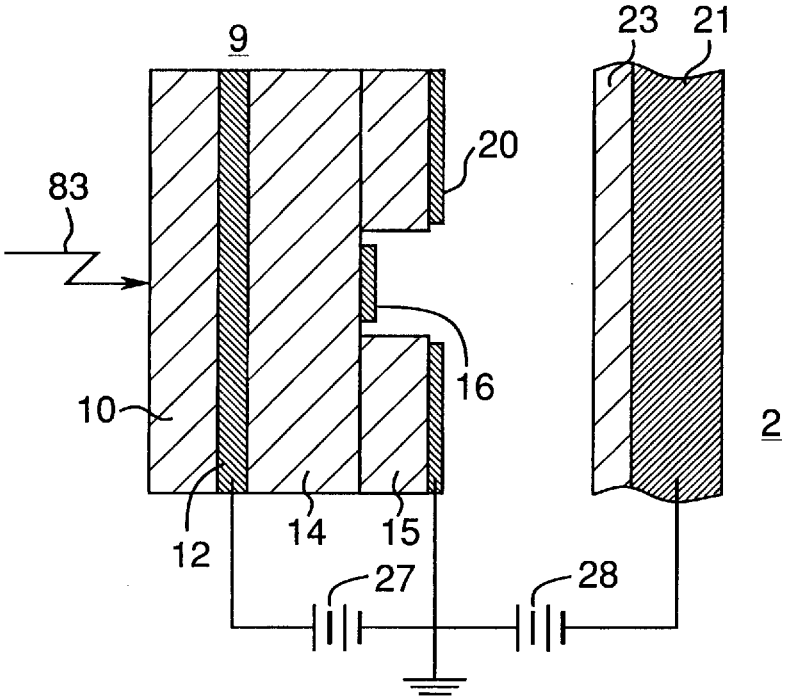
FIG. 8 is an enlarged sectional view of a photoelectric transfer device and an image carrying belt of an image forming apparatus according to a second embodiment of the present invention.

FIG. 8 shows a schematic view of an image forming apparatus, especially a image carrying belt 2 and a photoelectric transfer device 9 according to a second embodiment of the present invention.

The image carrying belt 2 has the same construction as the first embodiment in FIG. 4. A same numeral is affixed to the similar portion so as to omit the explanation thereof.

The photoelectric transfer device 9 has a similar construction to the photoelectric transfer device 9 in FIG. 4 according to the aforementioned first embodiment except an floating electrode 16 and a dielectric layer 15. A same numeral is affixed to the similar portion so as to omit the explanation thereof.

Figure 9:
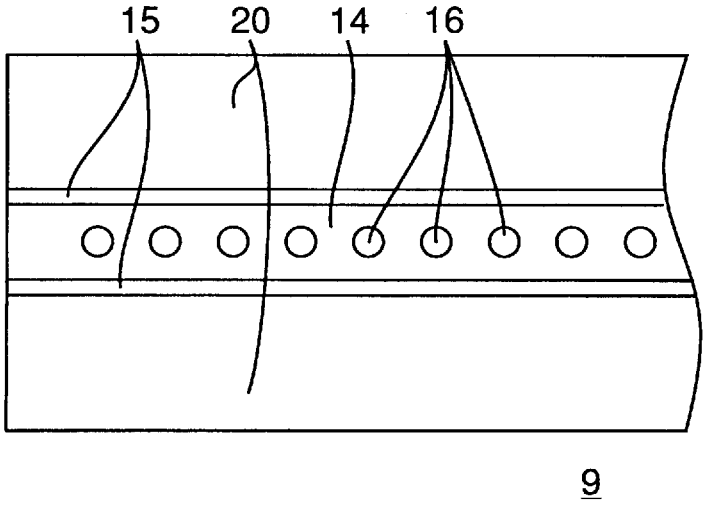
FIG. 9 is a view of a face of the photoelectric transfer device in FIG. 8 opposite to the image carrying member.

The floating electrode 16, as clearly shown in FIG. 9, comprises a plurality of substantially circular plate-like electrodes each having a diameter of about 30 $\mu$m and a thickness of 6 $\mu$m. The electrodes of the floating electrode 16 are positioned so as to come into contact with the charge transporting layer of the photoelectric transfer layer 14 and disposed in a line at regular intervals (80 $\mu$m) in the main scanning direction. Each electrode of the floating electrode 16 corresponds to the picture element of print.

The dielectric layer 15 is formed with a thickness of about 20 $\mu$m on the photoelectric transfer layer 14 except for an area extending in the main-scanning direction, including the line of the floating electrode 16 at center of the area and having a width of 80 $\mu$m in the sub-scanning direction. On the dielectric layer 15 except for the edge in the vicinity of the floating electrode 16 is formed a conductor as an acceleration electrode 20. The acceleration electrode 20 is grounded.

A laser beam 83 having a diameter of 80 $\mu$m measured in the sub-scanning direction on the photoelectric transfer device 9 is used.

In the image forming apparatus constructed as above, in the same manner as in FIG. 4, a voltage (Vc) of 1.2 kV is applied to the transparent conductive layer 12, the acceleration electrodes 20 are grounded (0 V), and a voltage of −(minus) 1 kV is applied to the base 21 of the image carrying belt 2 from the second electric supply 28. Therefore, an electric field exists in the photoelectric transfer layer 14 based on a voltage difference between the transparent conductive layer 12 and acceleration electrode 20 and base 21.

Figure 10:
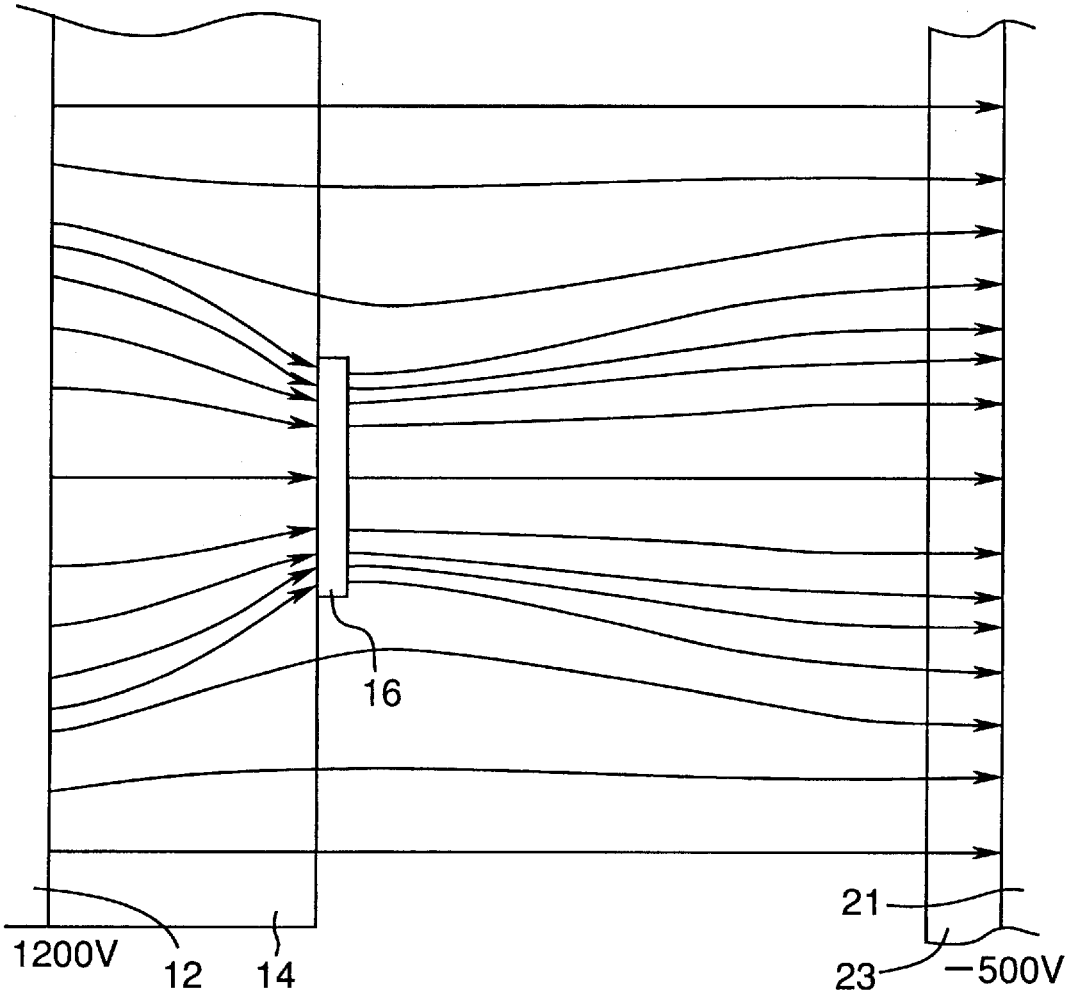
FIG. 10 is a graph showing lines of electric force of the photoelectric transfer device in FIG. 9.

The state of the electric field in the photoelectric transfer layer 14 is shown in FIG. 10. It is clear from FIG. 10 that the electric field in the photoelectric transfer layer 14 is curved toward the floating electrode 16 because the floating electrode 16 is provided on the surface of the photoelectric transfer layer 14.

In this condition, when a laser light 83 is irradiated to the photoelectric transfer layer 14, the floating electrode 16 increases in electric potential so that an electric discharge occurs between the floating electrode 16 and the acceleration electrode 20, whereby a part of charge is drawn to the image carrying belt 2 to form an electrostatic latent image on the dielectric layer 23. Since a voltage of −(minus) 1 kV is applied to the base 21 of the image carrying belt 2 by the second power source 28, the positive carriers become easier to fly, ensuring the capture of the carrier.

By providing the acceleration electrode 20, a long distance between the floating electrode 16 and the image carrying belt 2 is ensured and a permissible range of the distance is widened. Thus, even if the distance between the floating electrode 20 and the image carrying belt 2 varies a little due to an irregular or a deformation of the image carrying belt 2, it is acceptable.

Moreover, since the each floating electrode 16 is formed smaller than the diameter of the exposure spot, the carriers generated in the photoelectric transfer layer 14 concentrate on the floating electrode 16, thereby the electric discharge is stably caused from specified places to the image carrying belt 2 so that a predetermined electrostatic latent image is formed on the image carrying belt 2.

The photoelectric transfer device 9 of the second embodiment may be manufactured in the same manner as the first embodiment.

Figure 11:
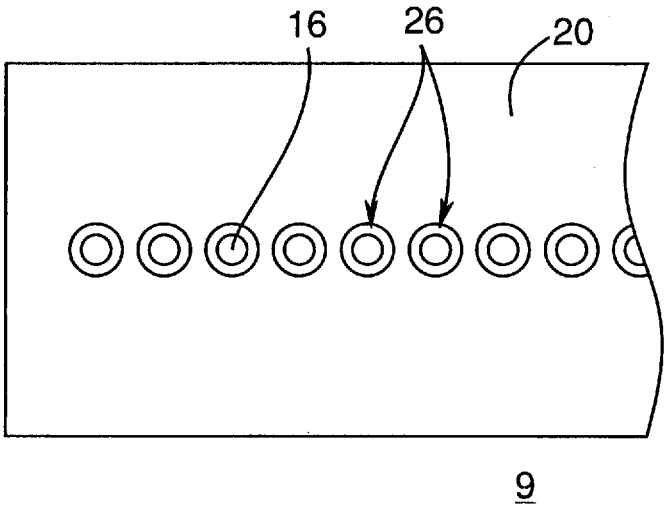
FIG. 11 is a view similar to FIG. 9 showing a first variation of the photoelectric transfer device in FIG. 9.

The configuration of the acceleration electrode 20 is not limited to the parallel line configuration as shown in FIG. 9, for example, a configuration provided with a plurality of circular holes corresponding to the electrodes of the floating electrode 16 is also acceptable. Concretely, as shown in FIG. 11, the dielectric layer is formed on the photoelectric transfer layer except the floating electrode 15 and an area of 10 $\mu$m surrounding the floating electrode 15. Thus, the dielectric layer 15 is formed with recesses 26 having the number corresponding to that of the floating electrode 16 and the floating electrode 16 is positioned on the bottom of each recess 26. Then, On the surface of the dielectric layer 15 is formed a conductive layer for the acceleration electrode 20 so that the electric discharge is caused between the floating electrode 16 and the open edge of the recess 26.

THIRD EMBODIMENT

Figure 12:
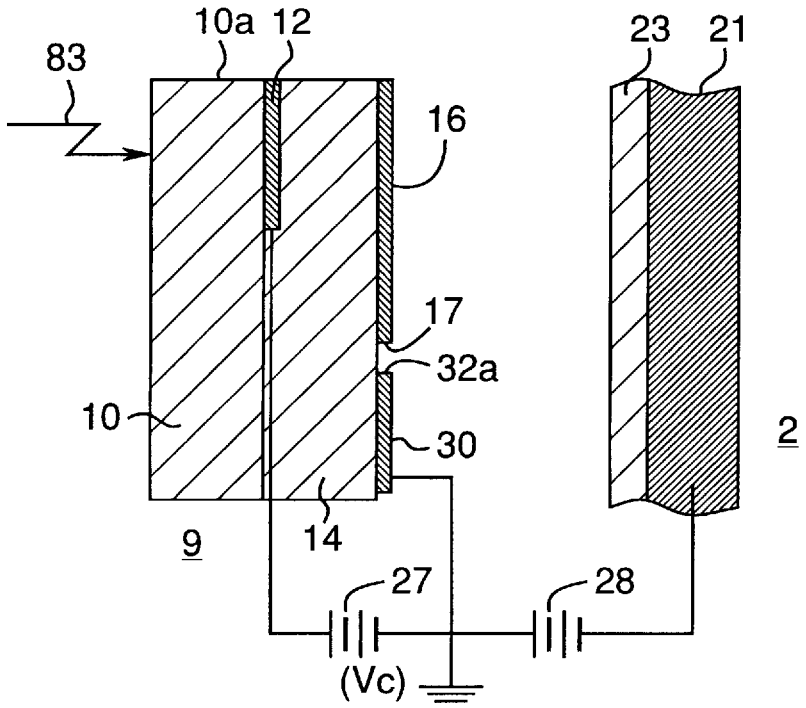
FIG. 12 is an enlarged sectional view of a photoelectric transfer device and an image carrying belt of an image forming apparatus according to third embodiment of the present invention.

FIG. 12 shows a schematic view of an image forming apparatus, especially a image carrying belt 2 and a photoelectric transfer device 9 according to a third embodiment of the present invention.

The image carrying belt 2 has the same construction as the first embodiment in FIG. 2. A same numeral is affixed to the similar portion so as to omit the explanation thereof.

The photoelectric transfer device 9 has a similar construction to the photoelectric transfer device 9 in FIG. 2 according to the aforementioned first embodiment except arrangement of a transparent conductive layer 12 and a floating electrode 16 and addition of an supplementary electrode 30. A same numeral is affixed to the similar portion so as to omit the explanation thereof.

The transparent conductive layer 12 is formed on the one third of the surface from the top end portion 10*a* of the transparent substrate 10.

Figure 13:
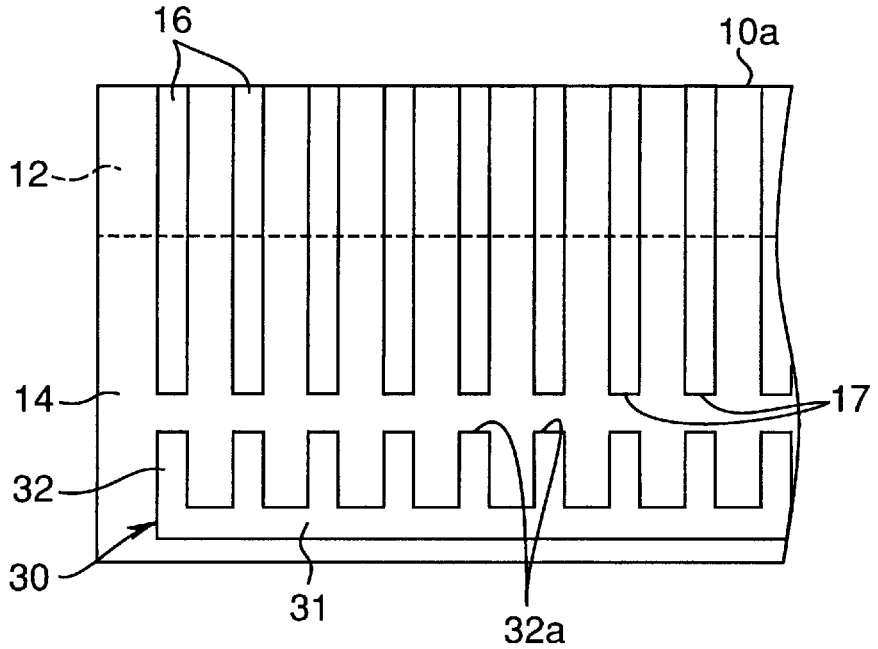
FIG. 13 is a view of a face of the photoelectric transfer device in FIG. 12 opposite to the image carrying member.
Figure 14:
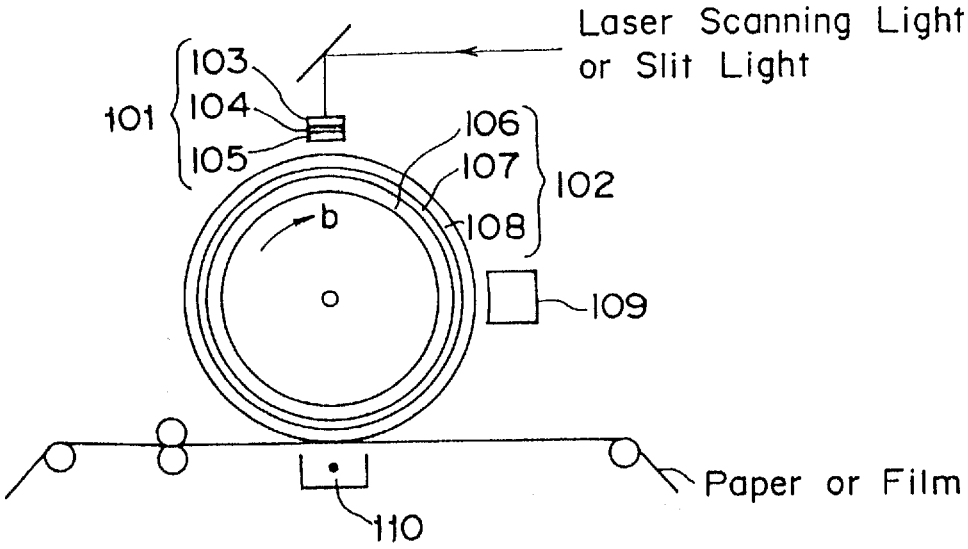
Fig.14 PRIOR ART
FIG. 14 is a sectional view of an image forming apparatus of prior art.

The floating electrode 16, as clearly shown in FIG. 13, comprises a plurality of electrodes which are formed on the photoelectric transfer layer 14 within an area of two third of the surface from the top end portion of the photoelectric transfer layer 14. The plurality of electrodes of the floating electrode 16 are provided so as to come into contact with the charge transporting layer of the photoelectric transfer layer 14 and disposed in parallel to each other at regular intervals in the main scanning direction. Each electrode of the floating electrode 16 corresponds to the picture element of print.

The supplementary electrode 30 is of the type of the teeth of the comb and is comprised of a base 31 and a plurality of projections 32. The supplementary electrode 30 is formed on the photoelectric transfer layer 14 within an area of one third of the surface from the bottom end portion of the photoelectric transfer layer 14. The end portion 32*a* of each projection 32 is opposed to the end portion 17 of each floating electrode 16 with a distance of 10 $\mu$m. The supplementary electrode 30 is grounded.

The relation of electric potential between the transparent conductive layer 12, the base 21 and the supplementary electrode 30 is described in the following formula:

$$EP12>EP30\geqq EP21,$$

or $$EP12<EP30\leqq EP21,$$

wherein EP12 denotes an electric potential of the transparent conductive layer 12, EP21 an electric potential of the base 21, and EP30 denotes an electric potential of the supplementary electrode 30. In the case of the present embodiment, since a voltage of 1.2 kV is applied to the transparent conductive layer 12 by the first electric supply 27, a voltage of –(minus) 2.0 kV is applied to the base 21 by the second electric supply 28, and the supplementary electrode 30 is grounded, the relation of relation of electric potential is P12>EP30>EP21.

In the image forming apparatus constructed as above, in the same manner as in FIG. 4, a voltage (Vc) of 1.2 kV is applied to the transparent conductive layer 12, the supplementary electrode 30 are grounded (0 V), and a voltage of –(minus) 1 kV is applied to the base 21 of the image carrying belt 2 from the second electric supply 28. Therefore, an electric field exists based on a voltage difference of 3.2 kV between the transparent conductive layer 12 and the base 21.

In this condition, when a laser light 83 is irradiated to the photoelectric transfer layer 14, the floating electrode 16 increases in electric potential so that an electric discharge occurs between the end portion 17 of the floating electrode 16 and the end portion 32*a* of the supplementary electrode 30, whereby a part of charge is drawn to the image carrying belt 2 to form an electrostatic latent image on the dielectric layer 23.

In this stage, although the electric potential between the floating electrode 16 and the image carrying belt 2 is larger than that between the floating electrode 18 and the supplementary electrode 30, the electric discharge occurs not between the floating electrode 16 and the image carrying belt 2 but between the floating electrode 16 and the supplementary electrode 30. This reason is as follows. The distance (200 $\mu$m) of the air gap between the floating electrode 16 and the image carrying belt 2 is extremely larger than the distance (10 $\mu$m) of the air gap between the floating electrode 16 and the supplementary electrode 30. Thus, the electric field between the floating electrode 16 and the supplementary electrode 30 exceeds a threshold value determined upon a Paschen's law prior to the electric field between the floating electrode 16 and the image carrying belt 2.

By providing the supplementary electrode 30, a long distance between the floating electrode 16, i.e., the photoelectric transfer device 9 and the image carrying belt 2 is ensured and a permissible range of the distance is widened. Thus, even if the distance between the floating electrode 16 and the image carrying belt 2 varies a little due to an irregular or a deformation of the image carrying belt 2, it is acceptable. Therefore, the work in both design and manufacturing stages become easier, which enables the cost reduction. Moreover, the electric discharge terminal 17 of the floating electrode 16 and the other electric discharge terminal, i.e., the supplementary electrode 30 keep a constant distance, the electric discharge between them is carried out in more stable condition.

The photoelectric transfer device 9 of the third embodiment may be manufactured in the same manner as the first embodiment except the supplementary electrode 30.

The supplementary electrode 30 may be formed on the photoelectric transfer layer 14 in the same manner to and simultaneously with the floating electrode 16. The projections 32 of the supplementary electrode 30 are arranged in a pitch of 80 $\mu$m in the same manner as the floating electrode 16. Each projection 32 has a width of 50 $\mu$m in the main-scanning direction and a length of 5 mm in the sub-scanning direction.

In the aforementioned third embodiment, although a –(minus) voltage is applied to the base 21 in order to ensure that a part of charge due to the electric discharge caused between the end portion 17 of the floating electrode 16 and the end portion 32*a* of the supplementary electrode 30 is drawn to the image carrying belt 2, it may be preferable to ground the base 21 in the same manner as the supplementary electrode 30.

OTHER EMBODIMENT

Although the semiconductor laser is used as a light source for exposing the photoelectric transfer device to light in either one of the aforementioned embodiments and variations, the present invention is not limited to this, and a known exposure method such as an LED system, an LCD shutter system or a PLZT system can be used so long as it can appropriately expose the photoelectric transfer device to light. Furthermore, it is a matter of course that an unexposed portion can be developed without developing an exposed portion by changing the characteristics of the developer and the like.

It is to be noted that the construction of the image carrying member is not limited to this kind of belt, and it may have a drum-like shape.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. An electrostatic recording apparatus for forming an electrostatic image on an electric charge carrying member, comprising:

a photoelectric transfer member spaced from the electric charge carrying member by a predetermined distance for generating carriers when being exposed to light;

a floating electrode provided on a first surface of the photoelectric transfer member, the floating electrode including a plurality of electrodes electrically insulated from each other, each electrode of the floating electrode being opposed to a first surface of the electric charge carrying member and having an electric discharge terminal thereon, close to the electric charge carrying member;

an electric power supply for applying a voltage between a second surface of the photoelectric transfer member and a second surface of the electric charge carrying member so that the electric potential of the photoelectric transfer member is higher than that of the electric charge carrying member; and an exposure device for exposing the second surface of the photoelectric transfer member, whereby the carriers generated in the photoelectric transfer member move toward said each electrode of the floating electrode to cause an electric discharge between the electric discharge terminal of said each electrode of the floating electrode and the electric charge carrying member, which allows an electrostatic image to be formed on the electric charge carrying member.

2. The electrostatic recording apparatus as in claim 1, wherein the photoelectric transfer member comprises:

a transparent substrate;

a transparent electrode provided on the transparent substrate, wherein a surface of the transparent electrode is the second surface of the of the photoelectric transfer member connected to the electric power supply; and a photoelectric transfer layer provided on the transparent electrode, wherein a surface of the transparent electrode is the first surface of the photoelectric transfer layer provided with said each electrode of the floating electrode.

3. The electrostatic recording apparatus as in claim 1, wherein the electric charge carrying member comprises:

a dielectric layer, wherein a first surface on the dielectric layer is said first surface of the electric charge carrying member that is opposed to said each electrode of the floating electrode of the photoelectric transfer member; and an opposite electrode provided on a second surface of the dielectric layer, wherein a surface of the opposite electrode is the second surface of the electric charge carrying member connected to the electric power supply.

4. The electrostatic recording apparatus as in claim 1, wherein each electrode has an elongated shape, and wherein the length of each electrode of the floating electrode is larger than a spot diameter of the light from the exposure device.

5. The electrostatic recording apparatus as in claim 1, wherein the floating electrode is formed with a projection having a needle-like tip end which serves as the electric discharge terminal.

6. The electrostatic recording apparatus as in claim 1, wherein the electric discharge terminal is an end portion of said each electrode of the floating electrode.

7. The electrostatic recording apparatus as in claim 6, wherein each electric discharge terminal is bent to form a peak portion which is close to the respective electrode of the floating electrode.

8. An electrostatic recording apparatus for forming an electrostatic image on an electric charge carrying member, comprising:

a photoelectric transfer member spaced from the electric charge carrying member by a predetermined distance for generating carriers when being exposed to light;

a floating electrode provided on a first surface of the photoelectric transfer member, the floating electrode being opposed to a first surface of the electric charge carrying member, and the floating electrode having an electric discharge terminal thereon close to the electric charge carrying member;

an electric power supply for applying a voltage between a second surface of the photoelectric transfer member and a second surface of the electric charge carrying member so that the electric potential of the photoelectric transfer member is higher than that of the electric charge carrying member;

an exposure device for exposing the second surface of the photoelectric transfer member, whereby the carriers generated in the photoelectric transfer member move toward the floating electrode to cause an electric discharge between the electric discharge terminal of the floating electrode and the electric charge carrying member, which allows an electrostatic image to be formed on the electric charge carrying member; and an acceleration electrode positioned apart from the electric discharge terminal of the floating electrode and by a predetermined distance from the electric charge carrying member.

9. An electrostatic recording apparatus for forming an electrostatic image on an electric charge carrying member, comprising:

a photoelectric transfer member which is spaced from the electric discharge carrying member with a predetermined distance and generates carriers when being exposed to light;

a floating electrode provided on a first surface of the photoelectric transfer member, the floating electrode being opposed to a first surface of the electric charge carrying member;

an acceleration electrode positioned apart from the floating electrode with a predetermined distance toward the electric charge carrying member; and a first electric power supply for applying a voltage between the second surface of the photoelectric transfer member and the acceleration electrode so that the electric potential of the photoelectric transfer member is higher than that of the acceleration electrode;

a second electric power supply for applying a voltage between the acceleration electrode and the second surface of the electric charge carrying member so that the electric potential of the acceleration electrode is higher than that of the electric charge carrying member; and an exposure device for exposing a second surface of the photoelectric transfer member, whereby the carriers generated in the photoelectric transfer member move toward the floating electrode to cause an electric discharge between the floating electrode and the acceleration electrode, which allows an electric charge generated by the electric discharge to be held on the electric charge carrying member to form an electrostatic image.

10. The electrostatic recording apparatus as in claim 9, wherein the photoelectric transfer member comprises:

a transparent substrate;

a transparent electrode provided on the transparent substrate, the transparent electrode being connected to the first electric power supply; and a photoelectric transfer layer provided on the transparent electrode, on the photoelectric transfer layer being provided the floating electrode.

11. The electrostatic recording apparatus as in claim 9, wherein the electric charge carrying member comprises:

a dielectric layer, a first surface of the dielectric layer being opposed to the floating electrode and the acceleration electrode of the photoelectric transfer member; and an opposite electrode provided on a second surface of the dielectric layer, the opposite electrode being connected to the second electric power supply.

12. The electrostatic recording apparatus as in claim 9, wherein the acceleration electrode is provided on a dielectric layer which is formed on the first surface of the photoelectric transfer member.

13. The electrostatic recording apparatus as in claim 12, wherein the acceleration electrode is disposed on both side of the floating electrode.

14. The electrostatic recording apparatus as in claim 12, wherein the acceleration electrode is disposed on a surrounding area of the floating electrode.

15. The electrostatic recording apparatus as in claim 9, wherein the floating electrode comprises a plurality of circular electrodes electrically insulated with each other.

16. The electrostatic recording apparatus as in claim 15, wherein the length of each diameter of the floating electrode is smaller than a spot diameter of the light from the exposure device.

17. An electrostatic recording apparatus for forming an electrostatic image on an electric charge carrying member, comprising:

a photoelectric transfer member which is spaced from the electric discharge carrying member with a predetermined distance and generates carriers when being exposed to light;

a floating electrode provided on a first surface of the photoelectric transfer member, the floating electrode being opposed to a first surface of the electric charge carrying member;

a supplementary electrode provided on the first surface of the photoelectric transfer member, the supplementary electrode being spaced from the floating electrode with a predetermined distance;

a first electric power supply for applying a voltage between the second surface of the photoelectric transfer member and the supplementary electrode so that the electric potential of the photoelectric transfer member is higher than that of the supplementary electrode;

a second electric power supply for applying a voltage between the supplementary electrode and the second surface of the electric charge carrying member so that the electric potential of the supplementary electrode is higher than that of the electric charge carrying member; and an exposure device for exposing a second surface of the photoelectric transfer member, whereby the carriers generated in the photoelectric transfer member move toward the floating electrode to cause an electric discharge between the floating electrode and the supplementary electrode, which allows an electric charge generated by the electric discharge to be held on the electric charge carrying member to form an electrostatic image.

18. The electrostatic recording apparatus as in claim 17, wherein the photoelectric transfer member comprises:

a transparent substrate;

a transparent electrode provided on the transparent substrate, the transparent electrode being connected to the first electric power supply; and a photoelectric transfer layer provided on the transparent electrode, on the photoelectric transfer layer being provided the floating electrode and the supplementary electrode.

19. The electrostatic recording apparatus as in claim 17, wherein the electric charge carrying member comprises:

a dielectric layer, a first surface of the dielectric layer being opposed to the floating electrode and the supplementary electrode of the photoelectric transfer member; and an opposite electrode provided on a second surface of the dielectric layer, the opposite electrode being connected to the second electric power supply.

20. The electrostatic recording apparatus as in claim 17, wherein the floating electrode comprises a plurality of electrodes electrically insulated with each other.

21. The electrostatic recording apparatus as in claim 17, wherein the supplementary electrode is of the type of teeth of comb comprising a base and a plurality of projections, and the projections are opposed to the end portions of the electrodes of the floating electrode.

22. An image forming apparatus, comprising:

a movable electric charge carrying member;

a photoelectric transfer member spaced from the movable electric charge carrying member by a predetermined distance for generating carriers when exposed to light;

a floating electrode provided on a first surface of the photoelectric transfer member, the floating electrode including a plurality of electrodes electrically insulated from each other, each electrode of the floating electrode being opposed to a first surface of the electric charge carrying member and having an electric discharge terminal thereon, close to the electric charge carrying member;

an electric power supply for applying a voltage between a second surface of the photoelectric transfer member and a second surface of the electric charge carrying member so that the electric potential of the photoelectric transfer member is higher than that of the electric charge carrying member; and an exposure device for exposing a second surface of the photoelectric transfer member, whereby the carriers generated in the photoelectric transfer member move toward said each electrode of the floating electrode to cause an electric discharge between the electric discharge terminal of said each electrode of the floating electrode and the electric charge carrying member, which allows an electrostatic image to be formed on the movable electric charge carrying member.

23. An image forming apparatus, comprising:

an electric charge carrying member movable to a predetermined direction;

a photoelectric transfer carrying member which is spaced from the electric charge carrying member with a predetermined distance and generates carriers when being exposed to light;

a floating electrode provided on a first surface of the photoelectric transfer member, the floating electrode being opposed to a first surface of the electric charge carrying member;

an acceleration electrode positioned apart from the floating electrode with a predetermined distance toward the electric charge carrying member; and a first electric power supply for applying a voltage between the second surface of the photoelectric transfer member and the acceleration electrode so that the electric potential of the photoelectric transfer member is higher than that of the acceleration electrode;

a second electric power supply for applying a voltage between the acceleration electrode and the second surface of the electric charge carrying member so that the electric potential of the acceleration electrode is higher than that of the electric charge carrying member; and an exposure device for exposing a second surface of the photoelectric transfer member, whereby the carriers generated in the photoelectric transfer member move toward the floating electrode to cause an electric discharge between the floating electrode and the acceleration electrode, which allows an electric charge generated by the electric discharge to be held on the electric charge carrying member to form an electrostatic image.

24. An image forming apparatus, comprising:

an electric charge carrying member movable to a predetermined direction;

a photoelectric transfer member which is spaced from the electric charge carrying member with a predetermined distance and generates carriers when being exposed to light;

a floating electrode provided on a first surface of the photoelectric transfer member, the floating electrode being opposed to a first surface of the electric charge carrying member;

a supplementary electrode provided on the first surface of the photoelectric transfer member, the supplementary electrode being spaced from the floating electrode with a predetermined distance;

a first electric power supply for applying a voltage between the second surface of the photoelectric transfer member and the supplementary electrode so that the electric potential of the photoelectric transfer member is higher than that of the supplementary electrode;

a second electric power supply for applying a voltage between the supplementary electrode and the second surface of the electric charge carrying member so that the electric potential of the supplementary electrode is higher than that of the electric charge carrying member; and an exposure device for exposing a second surface of the photoelectric transfer member, whereby the carriers generated in the photoelectric transfer member move toward the floating electrode to cause an electric discharge between the floating electrode and the supplementary electrode, which allows an electric charge generated by the electric discharge to be held on the electric charge carrying member to form an electrostatic image.

25. The image forming apparatus as in any one of claims 22 to 24, further comprising:

a developing device for developing the electrostatic image on the electric charge carrying member by toner to form a toner image; and a transfer device for transferring the toner image on the electric charge carrying member onto a recording medium.

* * * * *

UNITED STATES PATENT AND TRADEMARK OFFICE

CERTIFICATE OF CORRECTION

PATENT NO. : 5,862,443

DATED : January 19, 1999

INVENTOR(S) : Ikegawa et al.

It is certified that error appears in the above-identified patent and that said Letters Patent is hereby corrected as shown below:

In the claims:

Claim 2, line 7, delete "of the" (second occurence).

Signed and Sealed this

Sixth Day of March, 2001

Nicholas P. Godici

*Attest:*

NICHOLAS P. GODICI

*Attesting Officer*

*Acting Director of the United States Patent and Trademark Office*